US006997396B2

(12) United States Patent
Fedorov

(10) Patent No.: US 6,997,396 B2
(45) Date of Patent: Feb. 14, 2006

(54) BATTERY OPERATED AIRBRUSH

(75) Inventor: Gennadi I. Fedorov, Andover, NJ (US)

(73) Assignee: Rose Art Industries, Inc., Livingston, NJ (US)

( * ) Notice: Subject to any disclaimer, the term of this patent is extended or adjusted under 35 U.S.C. 154(b) by 103 days.

(21) Appl. No.: 10/641,436

(22) Filed: Aug. 15, 2003

(65) Prior Publication Data

US 2005/0072860 A1 Apr. 7, 2005

(51) Int. Cl.
*B05B 9/04* (2006.01)

(52) U.S. Cl. ..... 239/332; 239/369; 239/366; 239/368; 239/346; 239/375; 239/311

(58) Field of Classification Search ..... 239/332, 239/375, 378, 330, 302, 433, 409, 351, 354, 239/346, 311, 369, 366, 368
See application file for complete search history.

(56) References Cited

U.S. PATENT DOCUMENTS

| | | | | |
|---|---|---|---|---|
| 4,023,524 | A | 5/1977 | Goldfarb et al. | |
| 4,033,511 | A * | 7/1977 | Chamberlin | 239/346 |
| D247,506 | S * | 3/1978 | Bass | D23/226 |
| 4,154,375 | A * | 5/1979 | Bippus | 222/325 |
| D259,076 | S | 5/1981 | Doyel | |
| 4,549,243 | A * | 10/1985 | Owen et al. | 361/228 |
| D290,551 | S | 6/1987 | Huen | |
| 5,088,903 | A | 2/1992 | Tomatsu | |
| D335,170 | S * | 4/1993 | Hoogeveen, Jr. | D23/223 |
| 5,248,096 | A | 9/1993 | Hoey et al. | |
| 5,322,220 | A | 6/1994 | Rehkemper | |
| 5,409,166 | A * | 4/1995 | Gunzel et al. | 239/142 |
| 5,687,913 | A | 11/1997 | Robisch et al. | |
| 5,716,007 | A * | 2/1998 | Nottingham et al. | 239/332 |
| 6,354,517 | B1 | 3/2002 | Wu | |
| 6,557,785 | B1 | 5/2003 | Knapp | |
| D492,002 | S * | 6/2004 | Ptak et al. | D23/213 |
| 6,789,742 | B2 * | 9/2004 | Riley | 239/117 |

OTHER PUBLICATIONS

Co-pending U.S. Appl. No. 29/186,752 entitled "Battery Operated Airbrush", filed Jul. 22, 2003, Inventor: Gennadi Fedorov.

* cited by examiner

*Primary Examiner*—Dinh Q. Nguyen
(74) *Attorney, Agent, or Firm*—McCarter & English

(57) ABSTRACT

An airbrush as used for a media delivery system comprises an air pressurizer, a power source and a media reservoir integrated into a single hand held device. The air pressurizer comprises a pump and motor assembly delivering pressurized air by way of first and second air conduits to a nozzle. The media is stored in a detachable reservoir housed within the device and provided with a liquid conduit for conducting the media to the nozzle. Upon actuation of a spray button, the pump and motor assembly causes a stream of air to flow through the first and second air conduits and past an opening in the media conduit. Thus, a negative pressure is induced into the media conduit. The negative pressure draws liquid from the reservoir through the media conduit where it is entrained within the air stream as minute droplets and exits the body of the airbrush through a nozzle. In operation, the user depresses the spray button while moving the device in a desired pattern to produce the atomized spray and desired media coverage.

6 Claims, 8 Drawing Sheets

BATTERY OPERATED AIRBRUSH

FIELD OF THE INVENTION

This invention relates to apparatus for dispensing a spray of liquid particles and more particularly to liquid dispensing apparatus known as air brushes.

BACKGROUND OF THE INVENTION

Commercially available hand-held airbrushes are used in various commercial, educational, artistic and industrial operations. Such airbrushes typically comprise a liquid store connected to receive pressurized gas from a source. The pressurized gas is then passed over the liquid store to produce a spray of liquid particles which is directed by a nozzle onto an appropriate surface.

Many airbrushes are attached to compressors, paint containers, or even electrical outlets to give the airbrush the capability desired by its user. Some conventional air brushes employ a tank or canister of compressed gas such as compressed carbon dioxide to create the pressurized gas stream. In other cases, compressed air is generated by an air compressor and delivered to the air brush by way of a hose. Unfortunately, such arrangements have drawbacks in that they are cumbersome and expensive, are typically AC power driven machines, and comprise essential components that are housed separately from the air brush itself. Further, the increased complexity of the airbrush and its reliance on external power or wells is a direct limitation upon fine spraying necessary for various applications.

The present invention overcomes these disadvantages by providing an air brush which is self contained, simple, portable, safe and inexpensive, but at the same time provides the control and aesthetically pleasing results of a conventional air brush.

DETAILED DESCRIPTION OF THE INVENTION

The invention described below is particularly useful as an air brush for spraying media, for example, inks, paints, lacquers, dyes and the like, and will be described with reference thereto. However, the invention is capable of broader application and could be used for spraying numerous other fluids.

Figure 7:
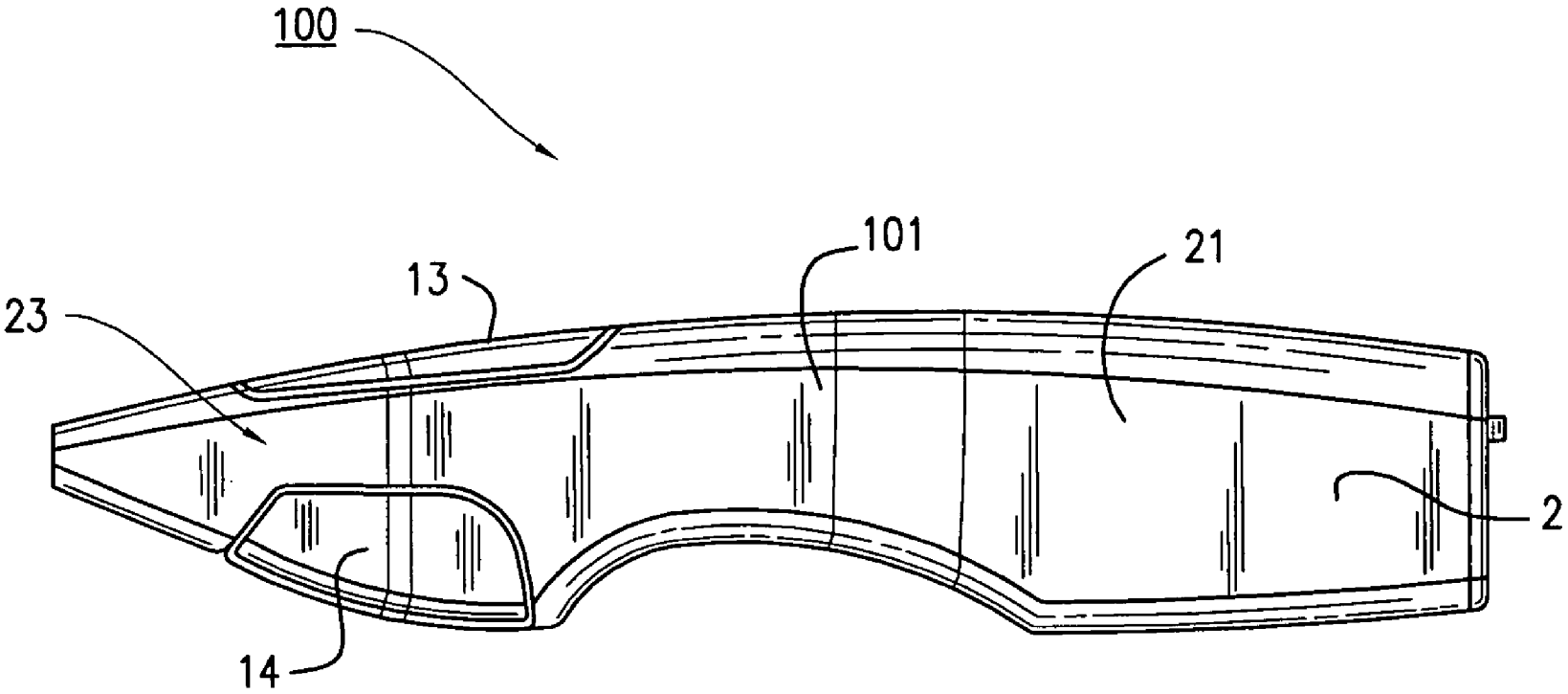
FIG. 7 is a left side view of an airbrush according to the embodiment shown in FIG. 1
Figure 8:
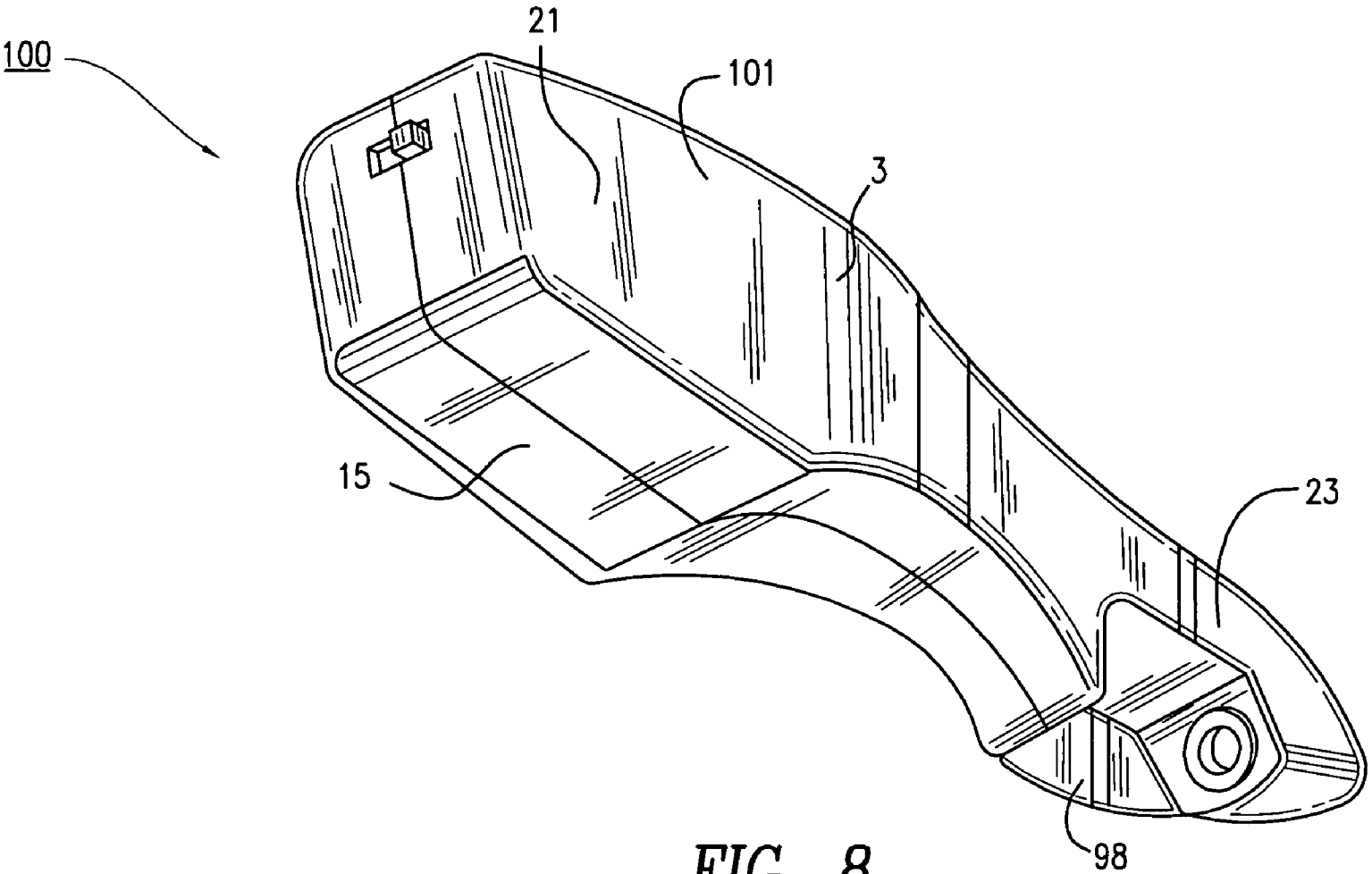
FIG. 8 is a perspective view of the airbrush according to the embodiment shown in FIG. 1

FIGS. 7 and 8 illustrate an airbrush 100 according to an embodiment of the invention assembled for operation. Airbrush 100 comprises a housing 101 generally forming a grip or handle portion 21 and a nose portion 23. Nose portion 23 includes a media reservoir 14, spray button 13 and a nozzle 7 for ejecting media when spray button 13 is depressed. In one embodiment of the invention, media reservoir 14 detachably engages an-exterior cavity 98 of housing 101 to allow easy removal of spent media reservoirs 14 and replacement with full media reservoirs 14. FIG. 8 illustrates the airbrush 100 of FIG. 7 with media reservoir 14 removed. Media reservoir 14 is formed from any suitable material, for example, glass or plastic.

Advantageously, airbrush 100 can be operated without the need for connection to external devices such as canisters or power sources. Upon actuation of a spray button 13, a spray of atomized media is dispensed from airbrush 100 through a nozzle 7. The operator depresses the spray button 13 while moving airbrush 100 in a desired pattern to produce the atomized spray and desired media coverage.

Figure 1:
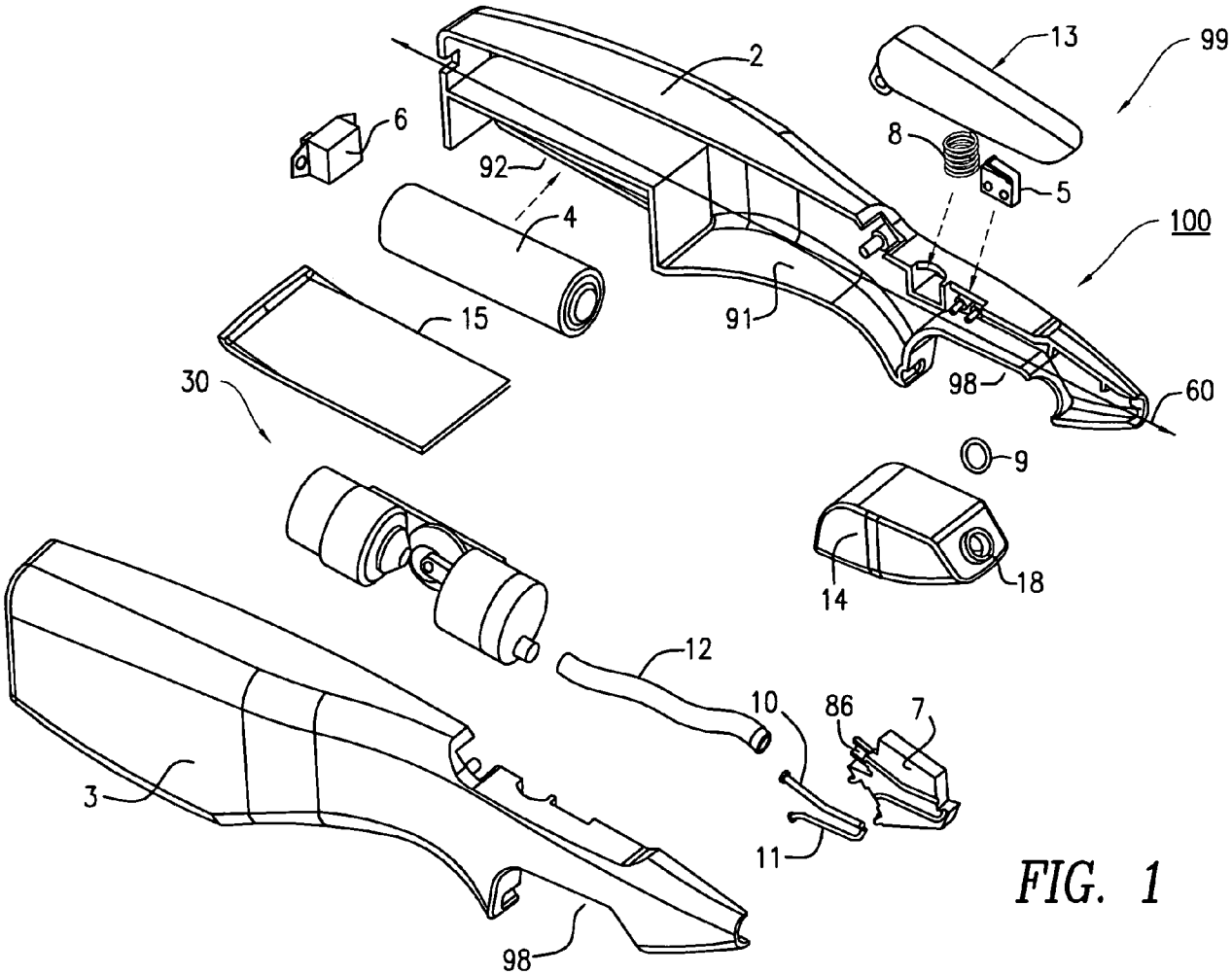
FIG. 1 is an exploded view of an air brush according to an embodiment of the invention.

An exploded view of airbrush 100 according to an embodiment of the invention is illustrated in FIG. 1. Airbrush 100 comprises a power source 4, an air pressurizer assembly 30, media reservoir 14, media conduit 11, first and second air conduits 12 and 10 respectively, nozzle assembly 7 including air inlet port 86 and switch assembly 99. In one embodiment of the invention nozzle assembly 7 is constructed from molded plastic shaped to form tubular first and second tubular cavities for conveying air and ink. In an alternative embodiment of the invention, air and ink conduits comprise separate metal tubes fitted inside air and ink cavities formed within nozzle 7. Switch assembly 99 comprises a button 13, a spring 8 and a switch 5.

An air brush 100 as used for a media delivery system comprises an air pressurizer 30, a power source 4 and a media reservoir 14 integrated into a single hand held device. The air pressurizer 30 comprises a pump e.g., a piston or diaphragm pump, and motor assembly delivering pressurized air by way of first and second air conduits to an area defined by said nozzle 7 and said housing 101, which is referenced herein as an entrainment chamber 7'. The media is stored in a detachable reservoir 14 housed within the device and provided with a liquid conduit 11 for conducting the media to the nozzle 7. Upon actuation of a spray button 13, the pump and motor assembly 30 causes a stream of air to flow through the first and second air conduits 12 and 10 into the entrainment chamber 7' and past an outlet of media conduit 11. Thus, a negative pressure is induced into the media conduit. The negative pressure draws liquid from the reservoir 14 through the media conduit 11 into the entrainment chamber 7', where it is entrained within the air stream exiting air conduit 10 as minute droplets and exits the nose portion 23 of the airbrush therefrom.

In one embodiment of the invention, the housing of air brush 100 is constructed from a pair of injection molded plastic housing halves 2 and 3 fastened together by a conventional means, such as screws, clips, glue, etc. Housing halves 2 and 3 are shaped so as to define at least one internal cavity having a longitudinal axis 60 and forming at least one interior compartment when halves 2 and 3 are joined. In the embodiment illustrated in FIG. 1, a first interior compartment 91 is formed so as to substantially encase air pressurizer assembly 30 when halves 2 and 3 are joined. A second interior compartment 92 is formed so as to substantially encase power source 4 when halves 2 and 3 are joined. A slidable panel 15 provides convenient access to second interior compartment 92 for easy removal and replacement of power source 4.

In on embodiment of the invention housing halves 2 and 3 are further shaped so as to form an exterior cavity 98. Exterior cavity 98 detachably receives media reservoir 14 while presenting an aerodynamic and unitary appearance. In one embodiment of the invention media reservoir 14 comprises a cartridge-like container for storing a reservoir of media.

Figure 2:
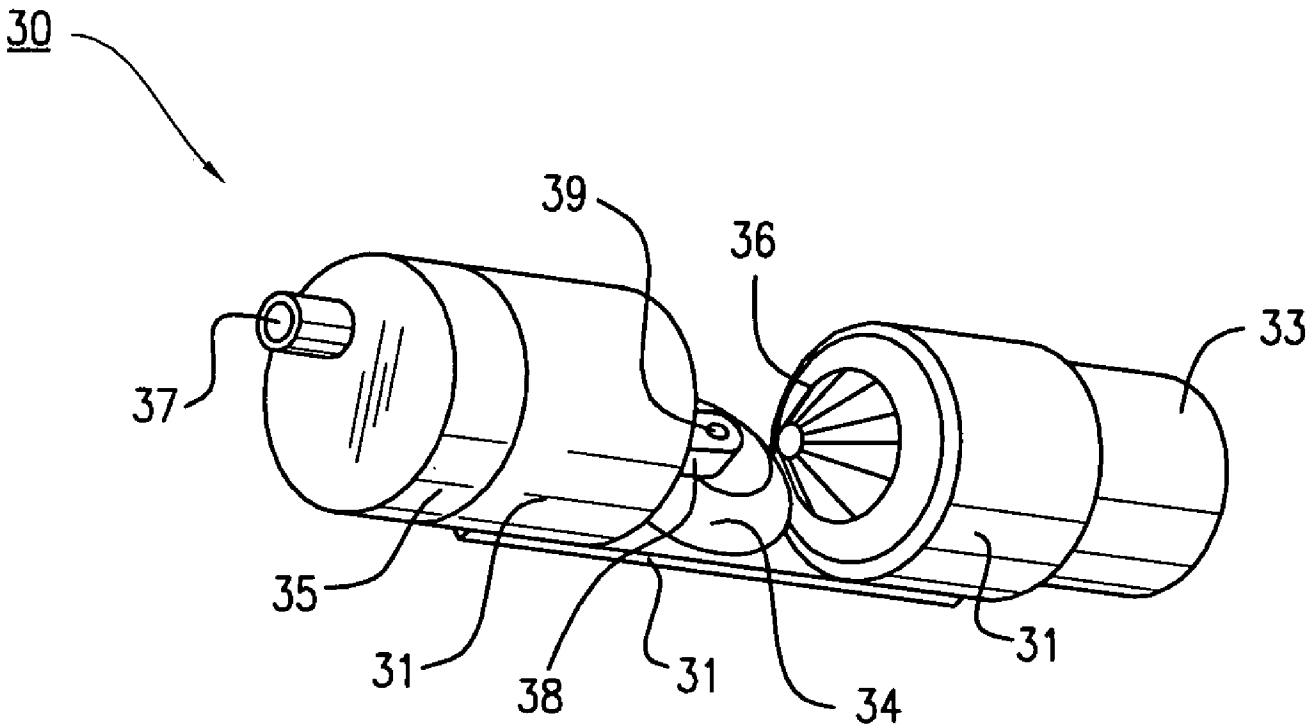
FIG. 2 is a perspective view of the compressor of the air brush illustrated in FIG. 1 according to an embodiment of the invention.

FIG. 2 illustrates an air pressurizer assembly 30 according to an embodiment of the invention. Air pressurizer assembly 30 comprises a piston pump 35 including a pressurized air outlet 37 and a piston driver 38; a motor 33 including a rotating shaft (not shown); a clutch 36 mounted on the rotating shaft; and a cam 34. The components of air pressurizer assembly 30 are held in fixed relation to one another and secured to housing 101 by means of a connecting clip 31. In an alternative embodiment of the invention a diaphragm pump is utilized in place of piston pump 35.

Figure 3:
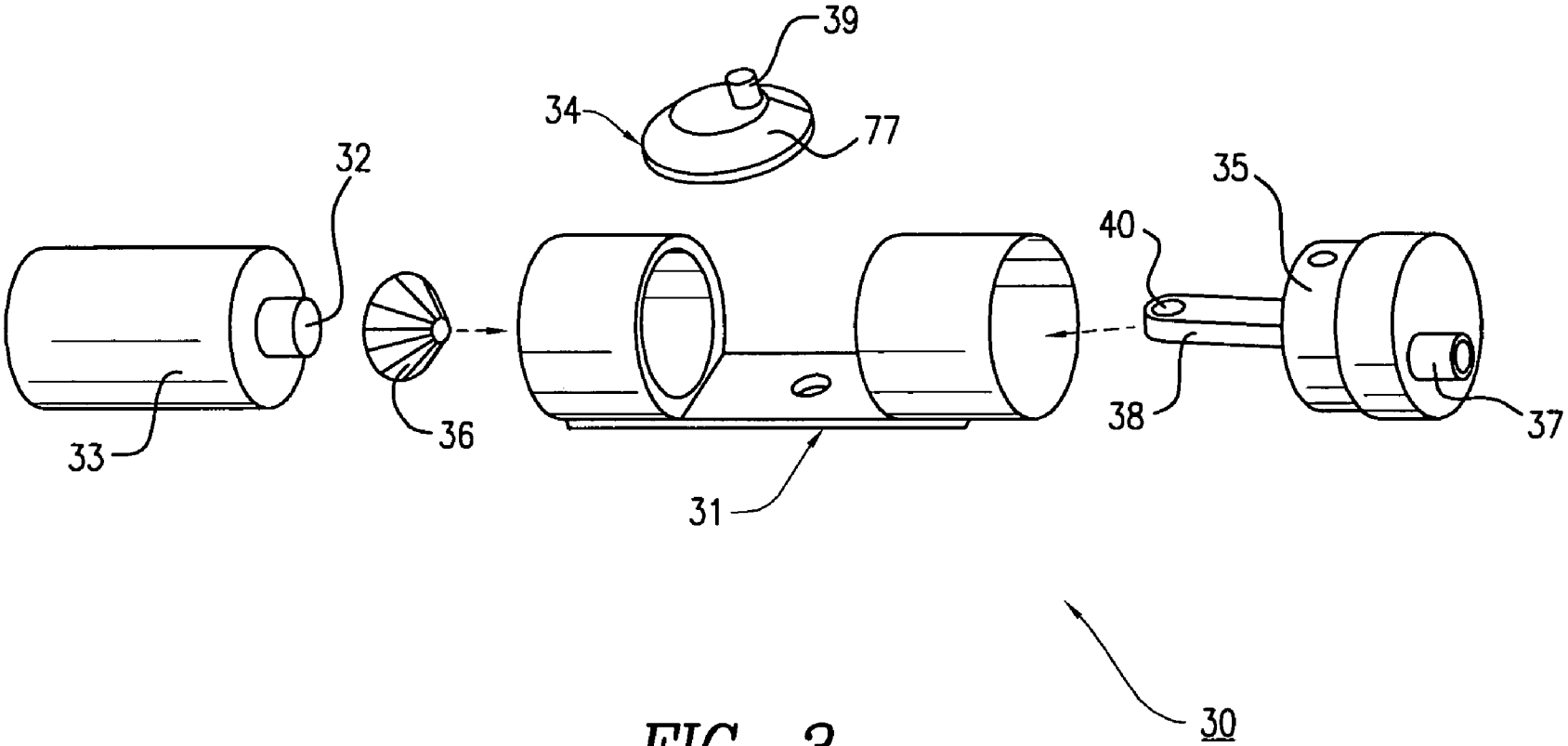
FIG. 3 is an exploded view of the compressor illustrated in FIG. 2

FIG. 3 is an exploded view of the pressurizer assembly 30 illustrated in FIG. 2. Driver arm 38 includes a circular opening 40 at its distal end. Cam 34 includes an eccentric pin 39 for engaging opening 40 of driver arm 38. An outer rim 77 of cam 34 is engages clutch 36 so that cam 34 rotates when engaged by clutch 36 and when motor 33 is energized. Rotational movement of cam 34 is translated into lateral movement of driver arm 30 by the engagement of eccentric pin 39 with opening 40 of driver arm 38. As cam 34 rotates driver arm 38 moves laterally and a piston (not shown) of piston pump 35 forces pressurized air from opening 37.

Figure 4:
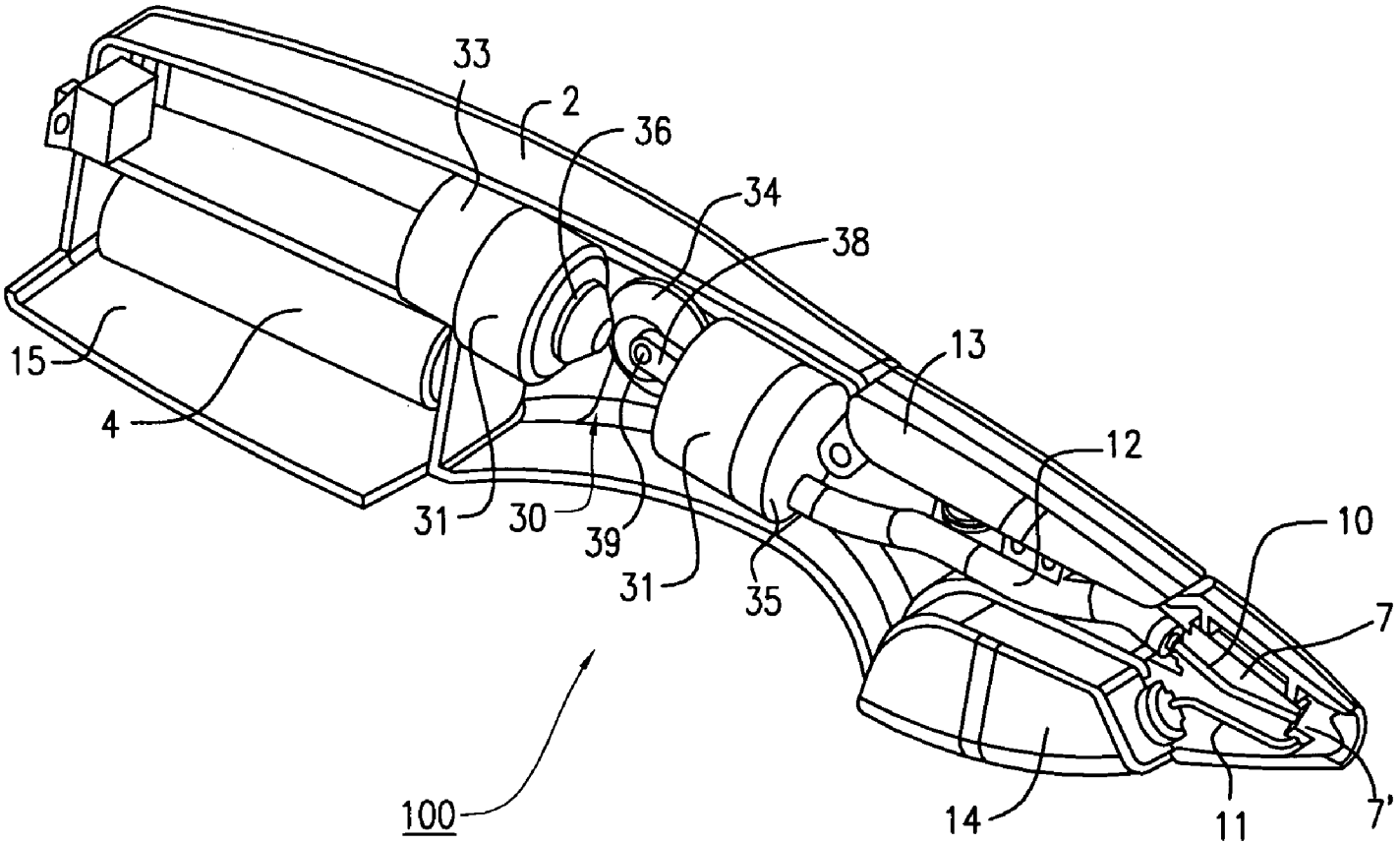
FIG. 4 is a left side cut-away view of the air brush of FIG. 1.

FIG. 4 is a side view of air brush 100 according to an embodiment of the invention. Pressurized air conveyed from air pressurizer 30 is conveyed along first air conduit 12 and through second air conduit 10 to fluid inlet port 86 of nozzle assembly 7 into the entrainment chamber 7'. In one embodiment of the invention, first air conduit 12 is a flexible pipe or tube. One end of first air conduit 12 engages opening 37 of air pressurizer 30. The other end of air conduit 12 is sealed in engagement with one end of second air conduit 10. The other end of second air conduit 10 (the air outlet end) is in fluid engagement with inlet port 86 of nozzle 7. Second air conduit 10 has a cross section sufficiently greater than the cross section of media conduit 11 so that the air speed of air flowing out of second air conduit 10 into the entrainment chamber 7' creates a zone of lower pressure relative to media conduit 11. Consequently air and liquid from media reservoir 14 are drawn from media reservoir 14 through media conduit 11 into the entrainment chamber 7'. As liquid media enters the air stream in the entrainment chamber 7', it breaks into particles and a fine mist is dispensed therefrom.

In one embodiment of the invention, power source 4 comprises 3 AAA batteries disposed within compartment 94 in operable connection with motor 33 of air pressurizier 30; Button 13, when depressed, causes a resilient metal contact to abut a terminal of power source 4 thereby completing an electrical circuit connecting the terminals of motor 33 to power source 4, to energize the motor 33.

Figure 5:
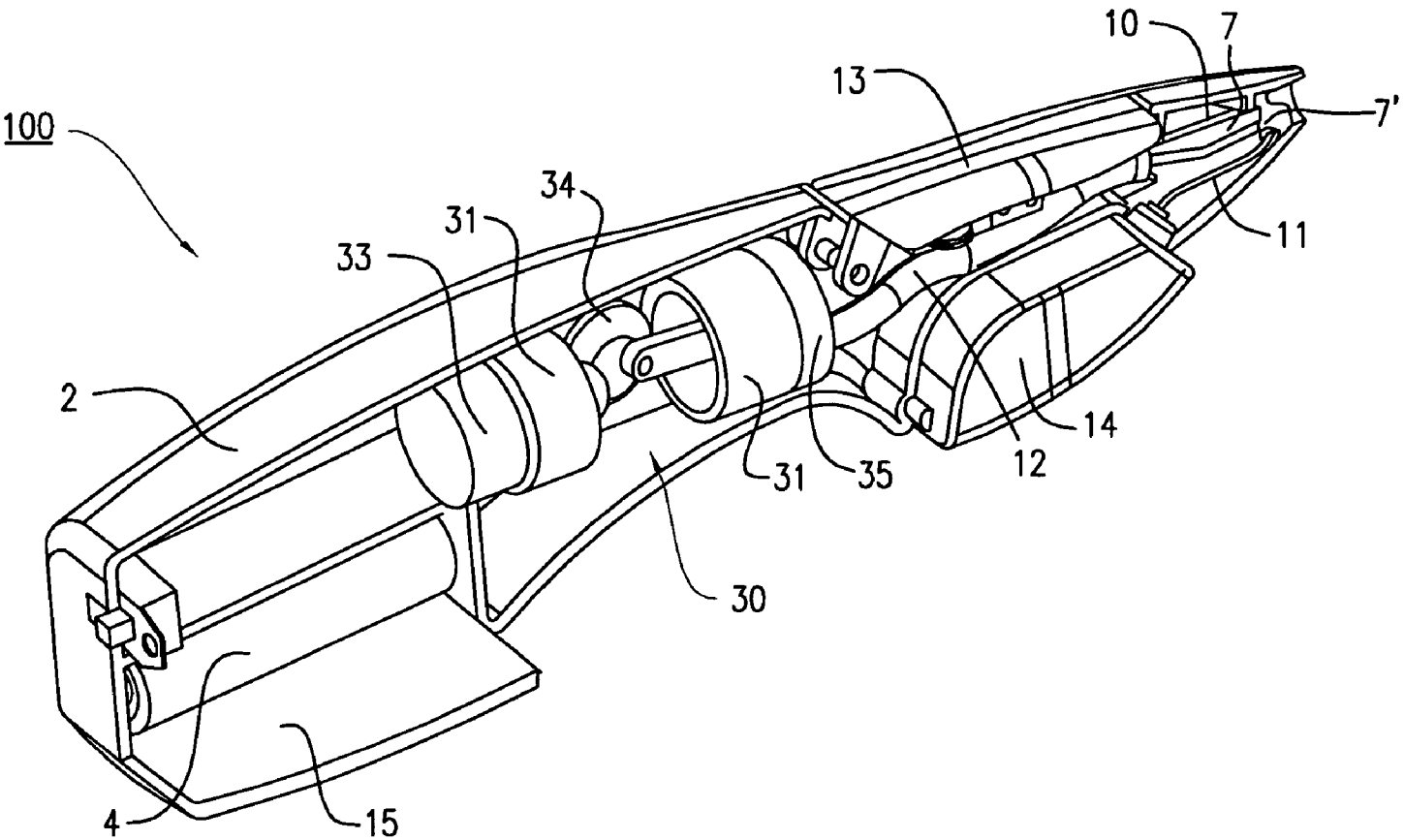
FIG. 5 is a right side cut-away view of the air brush of FIG. 1.
Figure 6:
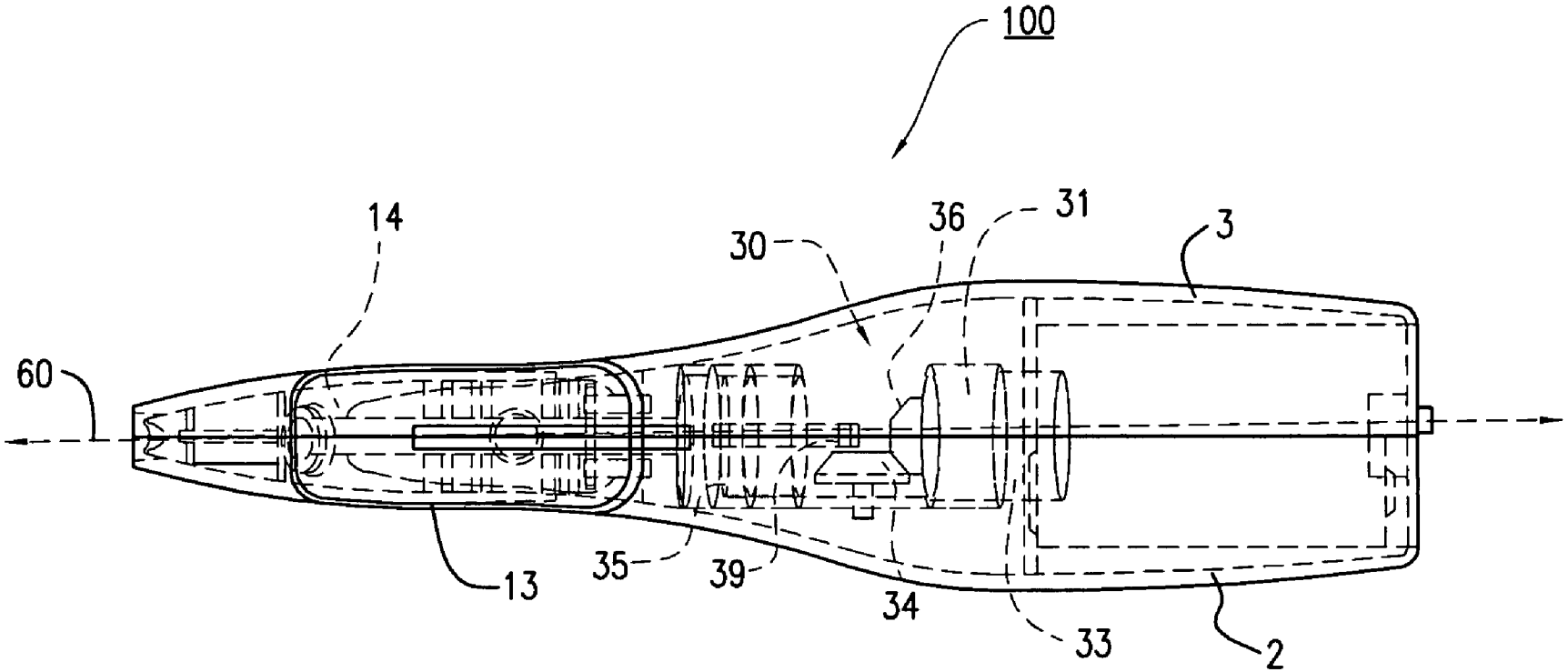
FIG. 6 is a top view of the airbrush of FIG. 1.

FIGS. 5 and 6 are a left side view of the airbrush of FIG. 4 and a top view of the airbrush of FIG. 4 respectively, illustrating the relative placement of components according to one embodiment of the invention.

While only a simple embodiment of the present invention as disclosed for purposes of illustration, it is obvious that many variations and modifications could be made thereto. It is intended to cover all of these variations and modifications which fall within the scope of the present invention as defined by the following claims:

I claim:

1. A liquid dispensing system, comprising:

a housing having a nose portion;

a nozzle assembly located in said nose portion of said housing, said nozzle assembly cooperating with said housing to define an entrainment chamber in said nose portion;

a reservoir for containing liquid media, said reservoir being fluidly connected to said entrainment chamber by a liquid media conduit at a liquid outlet thereof; and an air pressurizer fluidly connected to said entrainment chamber by at least one air conduit having an air outlet which is positioned proximal to said liquid outlet such that air flowing into said entrainment chamber creates a low pressure zone which draws liquid from said reservoir into said entrainment chamber where it mixes with air to a form an atomized stream.

2. The liquid dispensing system of claim 1, wherein said housing includes a handle section which is in substantial longitudinal alignment with said nose section.

3. The liquid dispensing system of claim 1, wherein said air pressurizer includes pumping means for forcing air into said entrainment chamber.

4. The liquid dispensing system of claim 1, wherein said at least one air conduit includes a first air conduit and a second air conduit.

5. The liquid dispensing system of claim 4, wherein said second air conduit includes said air outlet, and wherein said first air conduit connects said second air conduit to said air pressurizer.

6. The liquid dispensing system of claim 5, wherein said second air conduit has a first lateral cross section, and wherein said liquid media conduit has a second lateral cross section which is less than said first lateral cross section.

* * * * *